US011417308B2

(12) United States Patent
Plummer et al.

(10) Patent No.: US 11,417,308 B2
(45) Date of Patent: Aug. 16, 2022

(54) MULTIBAND FREQUENCY TARGETING FOR NOISE ATTENUATION

(71) Applicant: Andersen Corporation, Bayport, MN (US)

(72) Inventors: David D. Plummer, Hudson, WI (US); Todd Robert Duberstein, Greenfield, MN (US); Kevin T. Ferenc, Sun Prairie, WI (US)

(73) Assignee: Andersen Corporation, Bayport, MN (US)

( * ) Notice: Subject to any disclaimer, the term of this patent is extended or adjusted under 35 U.S.C. 154(b) by 0 days.

(21) Appl. No.: 17/170,402

(22) Filed: Feb. 8, 2021

(65) Prior Publication Data

US 2021/0264890 A1 Aug. 26, 2021

Related U.S. Application Data

(63) Continuation of application No. 16/402,550, filed on May 3, 2019, now Pat. No. 10,916,234.

(Continued)

(51) Int. Cl.
*G10K 11/178* (2006.01)

(52) U.S. Cl.
CPC .. *G10K 11/17823* (2018.01); *G10K 2210/119* (2013.01); *G10K 2210/129* (2013.01); *G10K 2210/3044* (2013.01)

(58) Field of Classification Search
CPC ..... G10K 2210/118; G10K 2210/1291; G10K 2210/3041; G10K 2210/3056; G10K 2210/3057
See application file for complete search history.

(56) References Cited

U.S. PATENT DOCUMENTS 4,352,039 A 9/1982 Hagood et al.
4,562,589 A 12/1985 Zalas et al.
(Continued)

FOREIGN PATENT DOCUMENTS

CN 112384973 2/2021
DE 19826171 10/1999
(Continued)

OTHER PUBLICATIONS

Chu, Y. J. "A New Regularized Subband ANC Algorithm With Online Secondary-Path Modeling: Performance Analysis and Application to Buildings," Building and Environment vol. 94 Part 2, Dec. 2015, pp. 873-882 (10 pages).
(Continued)

*Primary Examiner* — Kile O Blair
(74) *Attorney, Agent, or Firm* — Pauly, DeVries Smith & Deffner LLC

(57) ABSTRACT

Embodiments include systems with active sound canceling properties, fenestration units with active sound canceling properties, retrofit units with active sound canceling properties and related methods. In an embodiment a system can include a sound cancellation device include a sensing element to detect vibration of a transparent pane and/or a sound input device configured to detect sound incident on the transparent pane, as well as a vibration generator configured to vibrate the transparent pane and a sound cancellation control module. The sound cancellation control module can evaluate the detected vibration of the transparent pane at two or more discrete frequency bands. The sound cancellation control module can cause the vibration generator to vibrate the transparent pane causing destructive interference with sound waves at the two or more discrete frequency bands. Other embodiments are also included herein.

21 Claims, 15 Drawing Sheets

Related U.S. Application Data

(60) Provisional application No. 62/667,138, filed on May 4, 2018.

(56) References Cited

U.S. PATENT DOCUMENTS

| | | | | |
|---|---|---|---|---|
| 4,829,729 | A | 5/1989 | Derner et al. | |
| 5,018,203 | A * | 5/1991 | Sawyers | G10K 11/17875 381/71.2 |
| 5,315,661 | A | 5/1994 | Eatwell et al. | |
| 5,410,605 | A | 4/1995 | Sano et al. | |
| 5,526,292 | A | 6/1996 | Norris et al. | |
| 5,619,581 | A | 4/1997 | Ferguson et al. | |
| 5,629,986 | A | 5/1997 | Shoureshi et al. | |
| 5,638,454 | A | 6/1997 | Trinder et al. | |
| 5,754,662 | A | 5/1998 | Norris et al. | |
| 5,812,684 | A | 9/1998 | Mark et al. | |
| 5,838,802 | A | 11/1998 | Swinbanks et al. | |
| 5,907,624 | A | 5/1999 | Takada et al. | |
| 5,943,641 | A | 8/1999 | Carme et al. | |
| 5,978,489 | A | 11/1999 | Wan et al. | |
| 5,987,144 | A | 11/1999 | Carme et al. | |
| 6,023,123 | A | 2/2000 | Petiet et al. | |
| 6,178,246 | B1 | 1/2001 | Schmidts et al. | |
| 6,285,773 | B1 | 9/2001 | Carme et al. | |
| 6,343,129 | B1 | 1/2002 | Pelrine et al. | |
| 6,344,828 | B1 | 2/2002 | Grantz et al. | |
| 6,445,801 | B1 | 9/2002 | Pastor et al. | |
| 6,449,369 | B1 | 9/2002 | Carme et al. | |
| 6,466,673 | B1 | 10/2002 | Hardy et al. | |
| 6,560,342 | B2 | 5/2003 | Kang | |
| 6,564,640 | B1 | 5/2003 | Allaei et al. | |
| 6,590,985 | B1 | 7/2003 | Kirjavainen | |
| 6,957,516 | B2 | 10/2005 | Allaei et al. | |
| 7,594,359 | B2 | 9/2009 | Keefe et al. | |
| 7,639,826 | B1 | 12/2009 | Azima et al. | |
| 7,995,777 | B2 | 8/2011 | Yu et al. | |
| 8,006,442 | B2 | 8/2011 | Cheng et al. | |
| 8,199,924 | B2 | 6/2012 | Wertz et al. | |
| 8,229,126 | B2 | 7/2012 | Keane et al. | |
| 8,415,099 | B2 | 4/2013 | Drmanac et al. | |
| 9,224,382 | B2 | 12/2015 | Clemow | |
| 9,357,280 | B2 | 5/2016 | Mellow et al. | |
| 9,923,550 | B2 | 3/2018 | Argyropoulos et al. | |
| 10,049,654 | B1 * | 8/2018 | Wheeler | G10K 15/02 |
| 10,161,180 | B2 | 12/2018 | Carme | |
| 10,916,234 | B2 | 2/2021 | Plummer et al. | |
| 2002/0141599 | A1 | 10/2002 | Trajkovic et al. | |
| 2005/0026560 | A1 | 2/2005 | Villaverde et al. | |
| 2007/0223714 | A1 | 9/2007 | Nishikawa | |
| 2009/0016551 | A1 | 1/2009 | Chiang et al. | |
| 2009/0136052 | A1 | 5/2009 | Hohlfeld et al. | |
| 2012/0032632 | A1 | 2/2012 | Soar | |
| 2013/0208908 | A1 * | 8/2013 | Theiler | G10K 11/1783 381/71.6 |
| 2014/0259931 | A1 | 9/2014 | Plummer | |
| 2015/0104031 | A1 * | 4/2015 | Park | G10K 11/1783 381/71.6 |
| 2015/0358729 | A1 | 12/2015 | Xu et al. | |
| 2016/0019880 | A1 | 1/2016 | Davidson et al. | |
| 2016/0093282 | A1 | 3/2016 | Moshksar | |
| 2016/0171966 | A1 | 6/2016 | Molinari et al. | |
| 2018/0082673 | A1 | 3/2018 | Tzanetos | |
| 2018/0130455 | A1 | 5/2018 | Plummer et al. | |
| 2018/0298675 | A1 | 10/2018 | Bibens et al. | |
| 2018/0313138 | A1 | 11/2018 | Carme | |
| 2019/0341017 | A1 | 11/2019 | Plummer et al. | |

FOREIGN PATENT DOCUMENTS

| | | |
|---|---|---|
| DE | 10116166 | 10/2002 |
| EP | 3788619 | 3/2021 |
| GB | 2091064 | 7/1982 |
| JP | H04334653 | 11/1992 |
| JP | H06149267 | 5/1994 |
| JP | 2014232160 | 12/2014 |
| JP | 2015158542 | 9/2015 |
| WO | 9746176 | 12/1997 |
| WO | 2018089345 | 5/2018 |
| WO | 2019213503 | 11/2019 |

OTHER PUBLICATIONS

File History for Related U.S. Appl. No. 15/805,692 downloaded Mar. 16, 2021 (520 pages).

File History for U.S. Appl. No. 16/402,550 downloaded Mar. 16, 2021 (150 pages).

Hu, S. et al., "Directional Cancellation of Acoustic Noise for Home Window Applications," Applied Acoustics 74 (2013) 467-477 (11 pages).

"International Preliminary Report on Patentability," for PCT Application No. PCT/US2017/060354 dated May 23, 2019 (8 pages).

"International Preliminary Report on Patentability," for PCT Application No. PCT/US2019/030575 dated Nov. 19, 2020 (12 pages).

"International Search Report and Written Opinion," for PCT Application No. PCT/US2017/060354 dated Feb. 12, 2018 (11 pages).

"International Search Report and Written Opinion," for PCT Application No. PCT/US2019/030575 dated Jul. 31, 2019 (17 pages).

Lane, Jeremy "Active Control of Noise Through Windows," A thesis submitted in practical fulfilment of the requirements for the Degree of Masters in Engineering at the University of Canterbury, New Zealand 2013 (116 pages).

Liszewski, Andrew "A Stick on Speaker that Uses Your Windows to Silence Noises Outside," Gizmodo 2013 (3 pages).

Lyver, Des "Basics of Video Sound," Focal Press 1995, p. 38 (1 page).

"Non-Final Office Action," for U.S. Appl. No. 15/805,692 dated Apr. 29, 2021 (20 pages).

"Response to Communication Pursuant to Rules 161(1) and 162 EPC," for European Patent Application No. 19724669.7 filed Jun. 10, 2021 (20 pages).

"Response to Non-Final Office Action," for U.S. Appl. No. 15/805,692 filed Sep. 29, 2021 (14 pages).

* cited by examiner

MULTIBAND FREQUENCY TARGETING FOR NOISE ATTENUATION

This application is a continuation of U.S. patent application Ser. No. 16/402,550, filed May 3, 2019, which claims the benefit of U.S. Provisional Application No. 62/667,138, filed May 4, 2018, the content of which is herein incorporated by reference in its entirety.

FIELD

Embodiments herein relate to systems with active sound canceling properties, fenestration units with active sound canceling properties, retrofit units with active sound canceling properties and related methods.

BACKGROUND

Sound is a pressure wave. Active noise-cancellation generally functions by emitting a sound wave with the same amplitude but with an inverted phase (also known as anti-phase) to the original sound. The waves combine to form a new wave, in a process called interference, and effectively cancel each other out. This is known as destructive interference.

As used herein, fenestration units are items such as windows and doors that are placed within openings of a frame or wall of a structure. Fenestrations units typically have a substantially different construction than portions of the wall surrounding them. In particular, many fenestrations units include transparent portions and are designed to be opened. Because of their substantial differences, fenestrations units typically perform very differently than normal wall constructions in terms of insulating properties, sound transmission properties, and the like.

Various approaches to reducing sound transmission through fenestration units have been tried including mismatched glass, laminated glass, storm windows, dual units, and the like.

SUMMARY

Embodiments include systems with active sound canceling properties, fenestration units with active sound canceling properties, retrofit units with active sound canceling properties and related methods. In an embodiment an active noise cancellation system is included. The system can include a sound cancellation device configured to be connected to a transparent pane. The sound cancellation device can include a sensing element comprising at least one of a vibration sensor configured to detect vibration of the transparent pane and a sound input device configured to detect sound incident on the transparent pane. The sound cancellation device can further include a vibration generator configured to vibrate the transparent pane and a sound cancellation control module in direct or indirect communication with the sensing element and the vibration generator. The sound cancellation control module can evaluate the detected vibration of the transparent pane at two or more discrete frequency bands. The sound cancellation control module can cause the vibration generator to vibrate the transparent pane causing destructive interference with sound waves at the two or more discrete frequency bands. Other embodiments are also included herein.

In an embodiment, a fenestration unit with active sound canceling properties is included. The fenestration unit can include an insulated glazing unit mounted within a frame.

The insulated glazing unit can include an exterior transparent pane, an interior transparent pane, an internal space disposed between the exterior and interior transparent panes, and a spacer unit disposed between the exterior and interior transparent panes. An active noise cancellation system can also be included. The active noise cancellation system can include a sound cancellation device configured to be connected to at least one of the exterior and interior transparent pane. The sound cancellation device can include a sensing element including at least one of a vibration sensor configured to detect vibration of the transparent pane and a sound input device configured to detect sound incident on the transparent pane. The sound cancellation device can also include a vibration generator configured to vibrate the transparent pane and a sound cancellation control module in direct or indirect communication with the sensing element and the vibration generator. The sound cancellation control module can evaluate the detected vibration of the transparent pane at two or more discrete frequency bands. The sound cancellation control module can cause the vibration generator to vibrate the transparent pane causing destructive interference with sound waves at the two or more discrete frequency bands.

In an embodiment, a window unit with active sound canceling properties is included. The window unit can include a transparent pane and an active noise cancellation system. The active noise cancellation system can include a sound cancellation device configured to be connected to a transparent pane. The sound cancellation device can include a sensing element comprising at least one of a vibration sensor configured to detect vibration of the transparent pane and a sound input device configured to detect sound incident on the transparent pane. The sound cancellation device can also include a vibration generator configured to vibrate the transparent pane and a sound cancellation control module in direct or indirect communication with the sensing element and the vibration generator. The sound cancellation control module can evaluate the detected vibration of the transparent pane at two or more discrete frequency bands. The sound cancellation control module can cause the vibration generator to vibrate the transparent pane causing destructive interference with sound waves at the two or more discrete frequency bands.

In an embodiment, a method for attenuating sound incident on a pane of material is included. The method can include detecting vibration of the pane of material with a sensing element comprising at least one of a vibration sensor and a sound input device and generating vibration at two or more discrete frequency bands to cause destructive interference with incident sound waves causing vibration of the pane of material.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope herein is defined by the appended claims and their legal equivalents.

BRIEF DESCRIPTION OF THE FIGURES

Aspects may be more completely understood in connection with the following drawings, in which.

Figure 1:
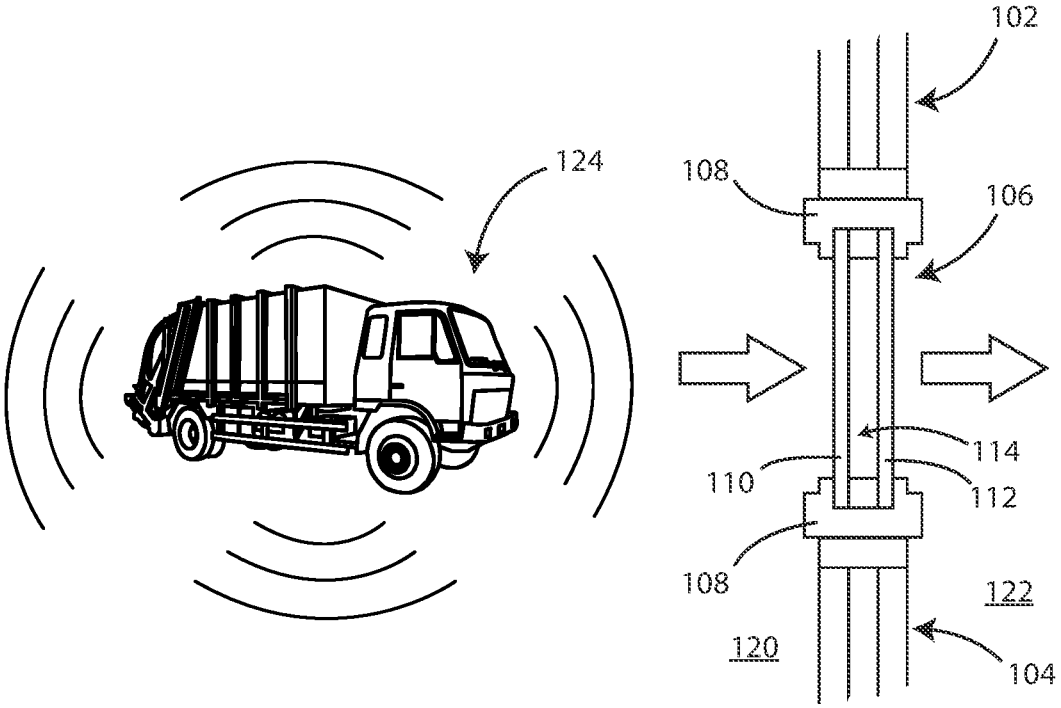
FIG. 1 is a schematic view showing how noise originating outside can pass through a fenestration unit.

While embodiments are susceptible to various modifications and alternative forms, specifics thereof have been shown by way of example and drawings, and will be described in detail. It should be understood, however, that the scope herein is not limited to the particular embodiments described. On the contrary, the intention is to cover modifications, equivalents, and alternatives falling within the spirit and scope herein.

DETAILED DESCRIPTION

In the context of a home or dwelling, fenestration units are the natural pathway for unwanted noise to enter the inside of the home or dwelling. For example, airplanes, trucks, trains and lawnmowers are all common noise producers and their high-volume sound can easily pass through fenestration units and disturb the occupants of a building, regardless of whether it is night or day. Reducing the volume of these undesirable sounds can make the interior space more peaceful and enjoyable.

In various embodiments herein, the volume of sound originating outside can be reduced by detecting such sound and then manipulating an interior pane of a multi-pane fenestration unit to cancel out, or greatly attenuate, the sound reaching the inside space of the dwelling or structure. In some embodiments, the interior pane can be manipulated to provide counter force to the interior transparent pane to reduce sound transmittance.

In some embodiments, external noise is picked up by a microphone, pressure sensor, or vibration sensor as it contacts (or just before or just after) an exterior pane of a fenestration unit. The signal is then processed to generate an inverse phase cancelling signal which is then applied to an interior pane, which is where cancellation of the noise can occur.

While not intending to be bound by theory, it is believed that creating cancelling sound or pressure waves targeting specific bandwidths can lead to more efficient and in some cases greater average sound attenuation than creating cancelling sound or pressure waves across a broad frequency range.

As such, in some embodiments, an active noise cancellation system is include having a sound cancellation device configured to be connected to a transparent pane. The sound cancellation device can include a sensing element comprising at least one of a vibration sensor configured to detect vibration of the transparent pane and a sound input device configured to detect sound incident on the transparent pane. The sound cancellation device can also include a vibration generator configured to vibrate the transparent pane. The sound cancellation device can also include a sound cancellation control module in direct or indirect communication with the sensing element and the vibration generator. The sound cancellation control module can evaluate the detected vibration of the transparent pane at two or more discrete frequency bands. In addition, the sound cancellation control module can cause the vibration generator to vibrate the transparent pane causing destructive interference with sound waves at the two or more discrete frequency bands. Various aspects will now be illustrated with respects to the figures.

Referring now to FIG. 1, a schematic view is shown illustrating how noise originating outside 120 of a dwelling or structure can pass through a fenestration unit 106 into the inside space 122. Noise can be generated in many different ways. In this example, a truck 124 is illustrated as the source of noise, however it will be appreciated that it could also be other things like a lawnmower, plane, road, train or the like. The sound can first contact the exterior pane 110 of the fenestration unit 106 and then pass through the internal space 114 and contact the interior pane 112 before entering the inside space 122 of the dwelling or structure. The fenestration unit 106 may include a frame 108 and be disposed within an aperture of a wall with an upper wall portion 102 above and a lower wall portion 104 below. However, the upper wall portion 102 and lower wall portion 104 may be thicker and formed of different materials such that less sound passes through those portions versus the fenestration unit. As such, in this example, the last point the noise passes through before entering the inside space 122 is the interior pane 112.

Figure 2:
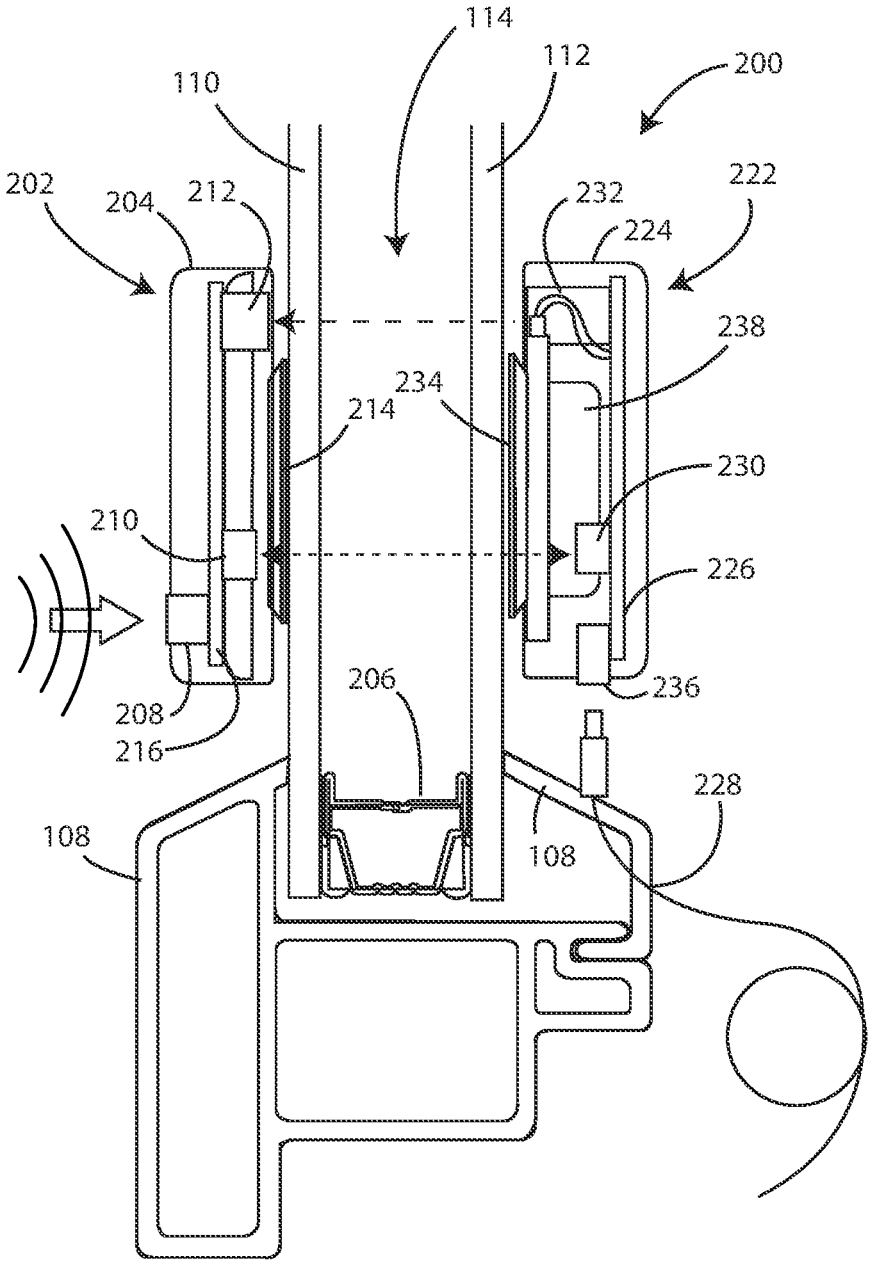
FIG. 2 is a schematic side view of a noise cancellation system in accordance with various embodiments herein.

Referring now to FIG. 2, a schematic side view is shown of a noise cancellation system 200 in accordance with various embodiments herein. In this example, the fenestration unit includes an insulated glazing unit having an exterior pane 110, an interior pane 112, and an internal space 114 disposed between the exterior pane 110 and the interior pane 112. The insulated glazing unit can further include a spacer unit 206 (or assembly) between the exterior pane 110 and the interior pane 112. The insulated glazing unit can be disposed within a frame 108.

The noise cancellation system 200 can include an active noise cancellation system including an exterior module 202 connected to the exterior pane 110. The exterior module 202 can include a housing 204. The exterior module 202 can be attached to the exterior pane 110 via an attachment platform 214 (or plate). The attachment platform 214 can be adhesively bonded (permanently or temporarily) to the exterior pane 110. In some embodiments, the attachment platform 214 can be attached to the exterior pane 110 using a suction cup or similar structure.

The exterior module 202 can include a sound input device 208. Exemplary sound input devices are described in greater detail below. The sound input device 208 (or sound pickup device, microphone, pressure sensor, vibration sensor, etc.) can detect sound and generate a signal therefrom. It will be appreciated that the position of the sound input device 208 relative to the exterior pane 110 can vary. In some embodiments, the sound input device 208 can be contacting the exterior pane 110. However, in other embodiments, the sound input device 208 can be spaced away from the exterior pane 110. For example, in some embodiments, the sound input device 208 (e.g., the portion of the sound input device registering sound) can be at least about 1, 2, 3, 4, 5, 7.5, 10, 15 or 20 millimeters away from the exterior surface of the exterior pane 110. In some embodiments, the sound input device 208 can be at a distance in a range wherein any of the foregoing distances can serve as the upper or lower bound of the range, provided that the upper bound is greater than the lower bound.

The exterior module 202 can also include a signal emitter 210, which can be configured to emit a signal based on a signal received from the sound input device 208.

The active noise cancellation system can also include an interior module 222 connected to the interior pane 112. The interior module 222 can include a housing 224. The interior module 222 can be attached to the interior pane 112 via an attachment platform 234 (or plate). The attachment platform 234 can be adhesively bonded (permanently or temporarily) to the interior pane 112. In some embodiments, the attachment platform 234 can be attached to the interior pane 112 using a suction cup or similar structure. The interior module 222 can include a signal receiver 230 to receive a signal from the signal emitter 210 of the exterior module 202. The interior module 222 can also include a vibration generator 238 configured to vibrate the interior pane 112. Aspects of exemplary vibration generators are discussed in greater detail below.

As described above, the signal emitter 210 of the exterior module 202 can emit a signal that is received by the signal receiver 230 of the interior module 222. In some embodiments, the signal emitter 210 can emit a wireless signal such as an RF signal, an optical signal, infrared signal, or the like. As such, the signal receiver can include an optical sensor, an RF antenna, or the like. This signal can include data regarding sound detected by the sound input device 208 of the exterior module 202. In some embodiments, the signal can be an analog signal. In other embodiments, the signal can be a digital signal. For example, the exterior module 202 can include an analog to digital converter in order to result in a digital signal representing the sound received by the exterior module 202. In some embodiments, the signal can reflect raw data regarding sound detected by the sound input device 208. In other embodiments, the signal can reflect data after one or more processing steps have taken place. The sound input device 208 can be connected to a printed circuit board 216 or other structural member inside the exterior module 202.

The interior module 222 can be powered by a power input line 228 which connects to a power input port 236. In some embodiments, the power input line 228 can be removed from the power input port 236. However, in other embodiments, the power input line 228 is fixed to the power input port 236.

In some embodiments, the noise cancellation system 200 can include components for transferring power from the interior module 222 to the exterior module 202. However, other embodiments do not include such a feature and power can be supplied to the interior module 222 and the exterior module 202 completely separately. In the embodiment shown, the interior module 222 can include an inductive power transmission emitter 232 and the exterior module 202 can include an inductive power transmission receiver 212. In this manner, power can be inductively transferred from the interior module 222 to the exterior module 202, eliminating the need for separate power supply wires connected to the exterior module 202. The inductive power transmission emitter 232 can be connected to a printed circuit board 226, or other structural member inside the interior module 222.

Figure 3:
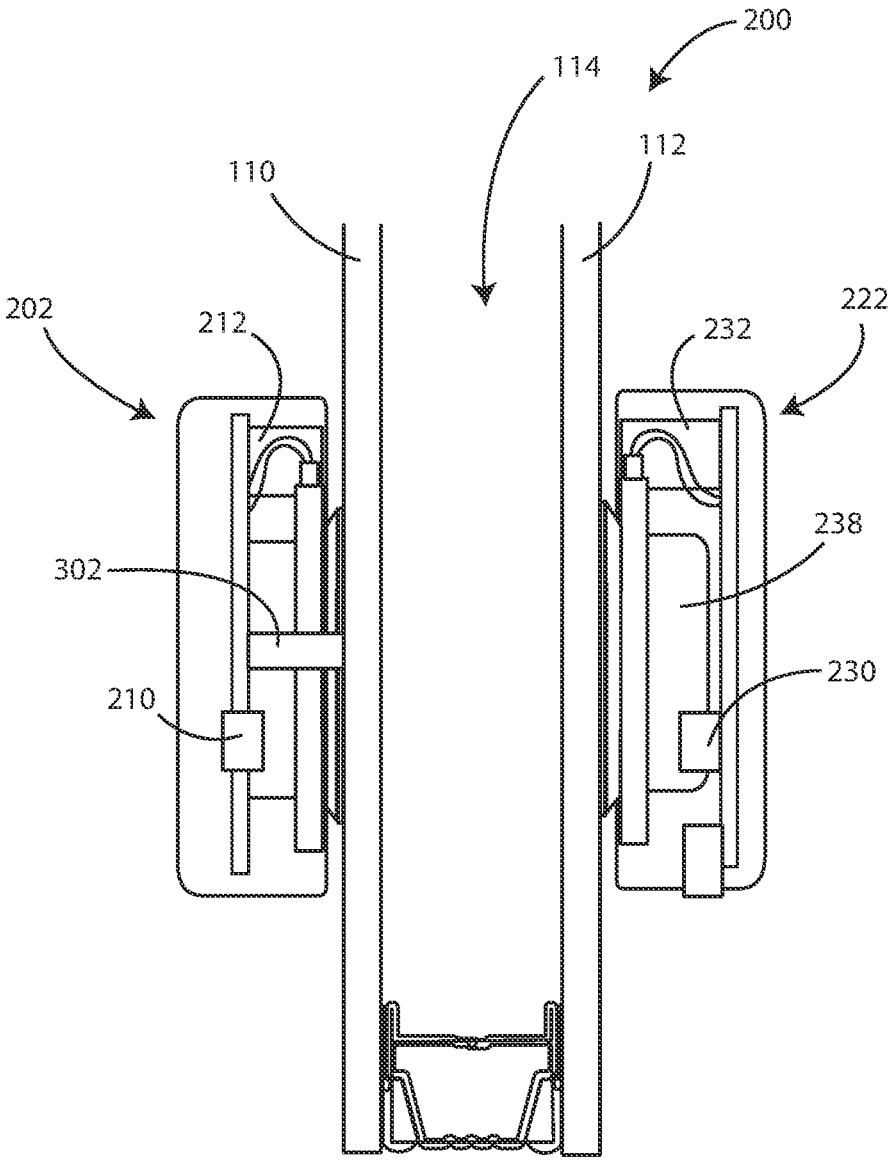
FIG. 3 is a schematic side view of a noise cancellation system in accordance with various embodiments herein.

In some embodiments, the exterior pane itself can be used to detect sound or as a portion of a mechanism to detect sound. For example, vibrations of the exterior pane can be detected and used as a proxy for the sound waves hitting the exterior pane from the outside. This can be in addition to, or instead of, a separate sound pickup device such as that discussed with regard to FIG. 2 above. Referring now to FIG. 3, a schematic side view is shown of a noise cancellation system 200 in accordance with various embodiments herein. In this embodiment, the exterior pane 110 itself can serve as a sound pick-up device, microphone or portion thereof. For example, vibrations of the exterior pane 110 can be sensed, which can be indicative of sound received by or otherwise impacting the exterior pane 110. In specific, a device 302, such as an accelerometer or similar device, can detect vibrations of the exterior pane 110 and generate signals therefrom.

As before, the exterior pane 110 can be separated from an interior pane 112 by an internal space 114. The exterior module 202 can also include a power transmission receiver 212, and a signal emitter 210. The interior module 222 can also include a power transmission emitter 232, a signal receiver 230, and a vibration generator 238.

It will be appreciated that vibrations of the exterior pane 110 can be sensed in many different ways. In some embodiments, a piezoelectric device can be used to sense vibrations of the exterior pane 110. Piezoelectric devices generate an AC voltage when subjected to mechanical stress or vibration. In some embodiments, a flexion sensor can be used to sense vibration of the exterior pane. Some flexion sensors can function as a variable resistor, wherein resistance changes as the sensor flexes.

Figure 4:
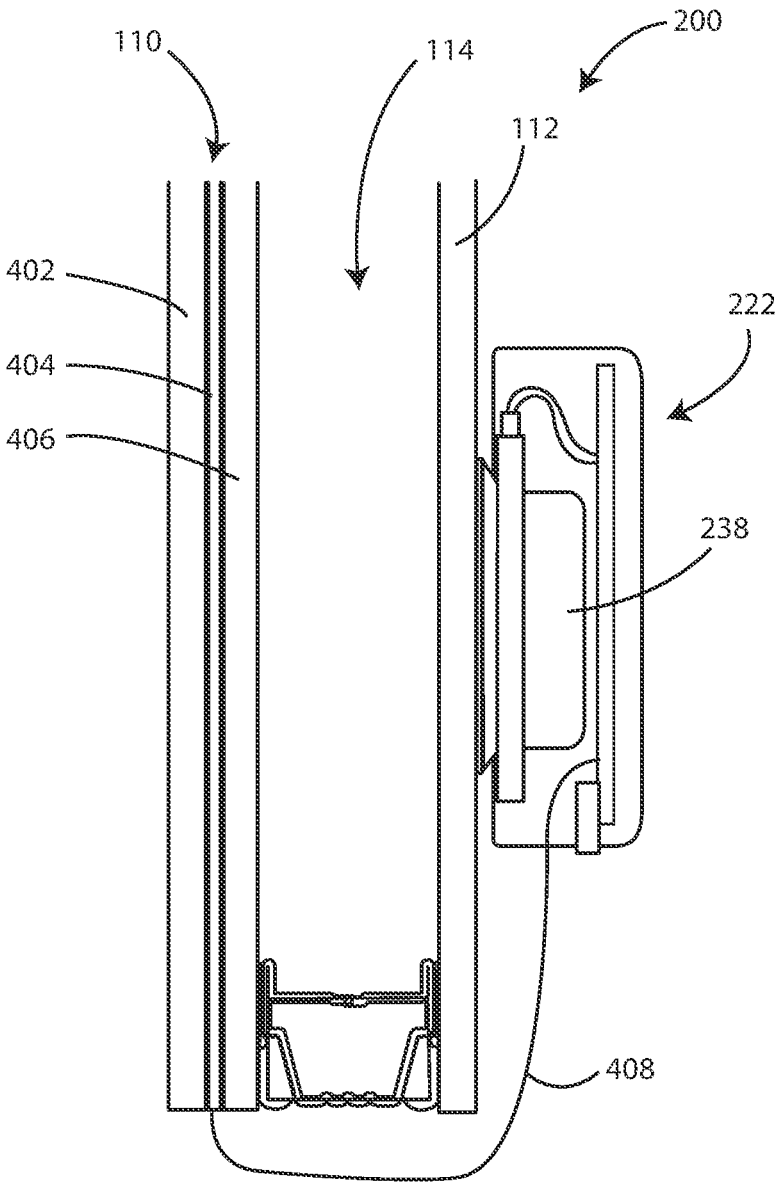
FIG. 4 is a schematic side view of a noise cancellation system in accordance with various embodiments herein.

Referring now to FIG. 4, a schematic side view is shown of a noise cancellation system 200 in accordance with various embodiments herein. In this embodiment, the exterior pane 110 can include a first sheet 402 and a second sheet 406, with a piezoelectric device 404 sandwiched between first sheet 402 and the second sheet 406. As the exterior pane 110 vibrates, a signal can be created by the piezoelectric device 404. The signal can be conveyed to the interior module 222 via a signal line 408. However, in some embodiments the signal can be conveyed to the interior module 222 wirelessly.

Figure 5:
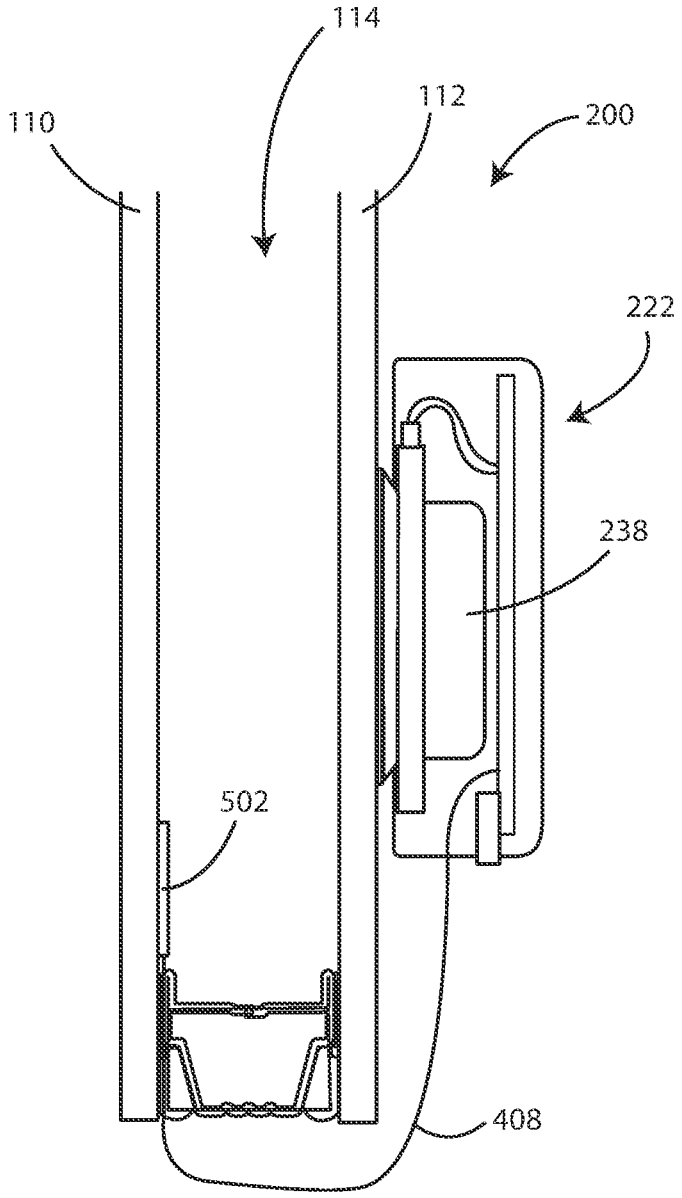
FIG. 5 is a schematic side view of a noise cancellation system in accordance with various embodiments herein.

However, it will be appreciated that a piezoelectric device need not be sandwiched in between two panes in order to be operative to detect vibrations. For example, in some embodiments, a piezoelectric device can be attached to the exterior pane 110 either on the inside or outside thereof. Referring now to FIG. 5, a schematic side view is shown of a noise cancellation system 200 in accordance with various embodiments herein. In this embodiment, a piezoelectric element 502 is adhered to the interior surface of the exterior pane 110. As the exterior pane 110 vibrates, a signal can be created by the piezoelectric element 502. The signal can be conveyed to the interior module 222 via a signal line 408 which can form part of a signal circuit. However, in some embodiments the signal can be conveyed to the interior module 222 wirelessly.

Figure 6:
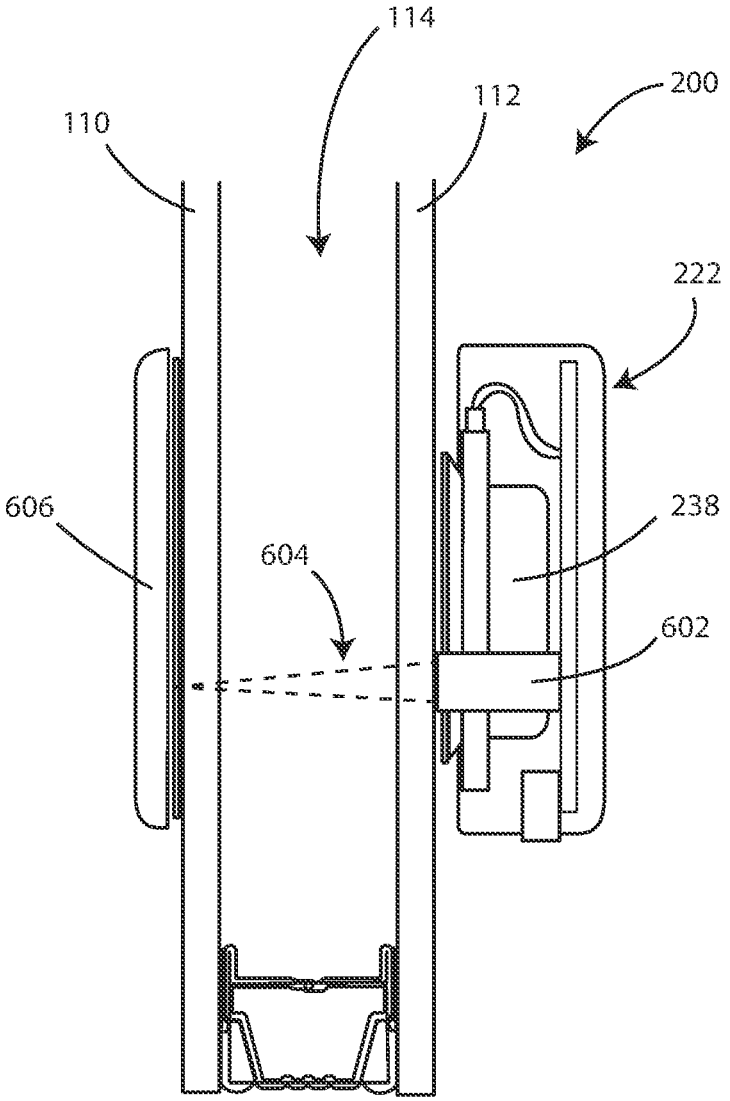
FIG. 6 is a schematic side view of a noise cancellation system in accordance with various embodiments herein.

In some embodiments, vibrations of an exterior pane can be detected purely from the interior module 222 or another device on the inside of the interior pane 112. Referring now to FIG. 6, a schematic side view is shown of a noise cancellation system 200 in accordance with various embodiments herein. In this embodiment, an optical emitter/receiver 602 associated with the interior module 222 can emit an optical beam 604 which can bounce off of an exterior reflector 606 before being received by the emitter/receiver 602. In some embodiments the emitter and receiver are two separate components, in other embodiments they are a single component. In some embodiments, the optical beam can be coherent light, such as with a laser beam. In other embodiments the optical beam can be infrared, ultraviolet, visible light, or the like. Vibrations of the exterior pane 110 can be manifested as deflections of the optical beam 604 as it is received by the emitter/receiver 602. These deflections can, in turn, be processed into a signal reflective of the incoming sound.

While FIG. 6 shows an exterior reflector 606, it will be appreciated that this separate structure can be excluded from some embodiments or can be in a different position in some embodiments. For example, in some embodiments a reflector can be disposed on the interior surface of the exterior pane. In some embodiments the interior surface of the exterior pane itself may function as an effective reflector. In some embodiments, a coating on the pane, such as on a pane of glass, can serve as a reflector. In some embodiments, a low-e coating on glass can serve as a reflector.

Figure 7:
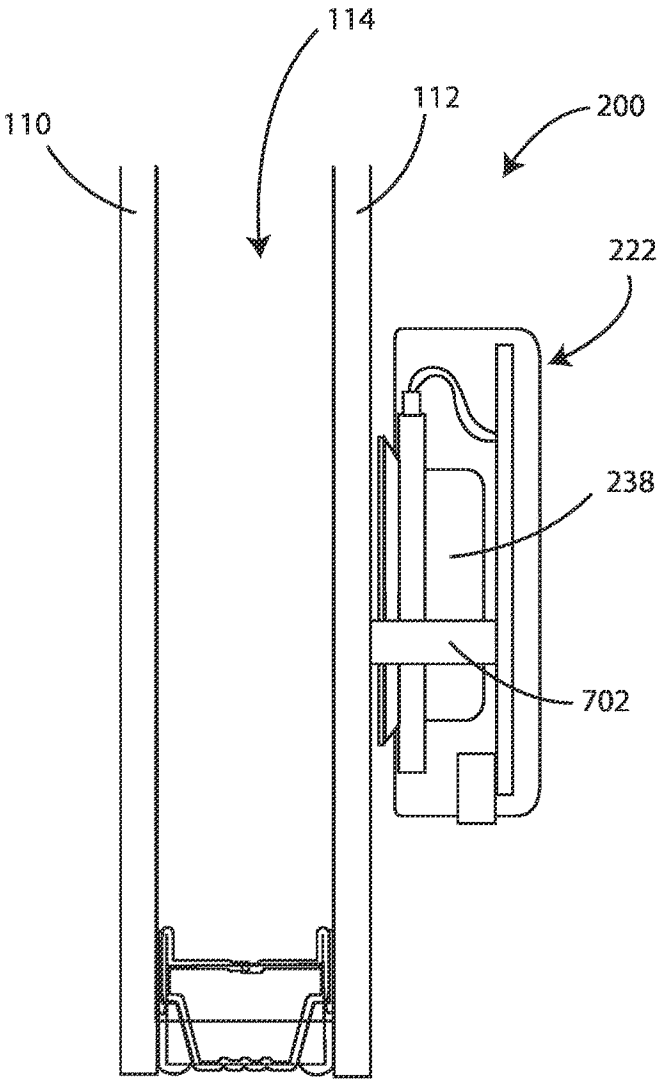
FIG. 7 is a schematic side view of a noise cancellation system in accordance with various embodiments herein.

In some embodiments noise/sound detection functions can be coupled with noise cancellation functions all in the interior module 222, eliminating the need for a separate exterior module. Referring now to FIG. 7, a schematic side view is shown of a noise cancellation system 200 in accordance with various embodiments herein. The interior module 222 of the noise cancellation system 200 can include a sound or vibration sensor 702. The sound or vibration sensor 702 can detect vibrations of the interior pane 112. It will be appreciated that while many of the views shown herein include two panes of glass, various embodiments herein will work with glazing units including a single transparent pane or more than two panes. In addition, it should be appreciated that units herein can be used in many contexts including fenestration units for commercial and residential buildings, window units for vehicles, and the like.

Figure 8:
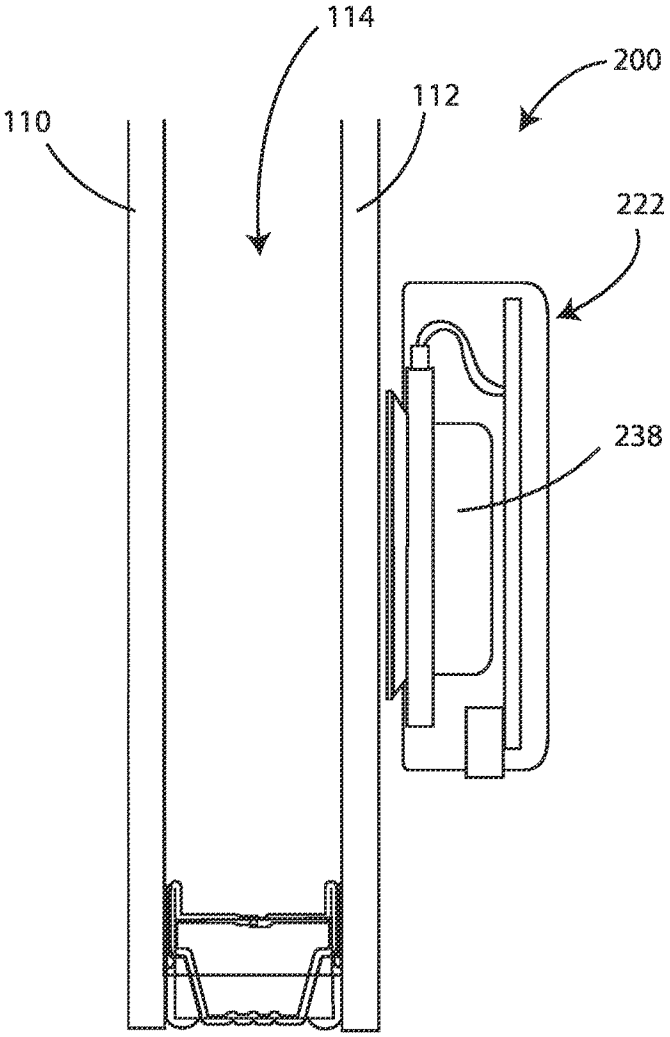
FIG. 8 is a schematic side view of a noise cancellation system in accordance with various embodiments herein.

In some embodiments, the same device used to vibrate the interior pane 112 can also be used to detect vibrations of the interior pane 112. Referring now to FIG. 8, a schematic side view is shown of a noise cancellation system 200 in accordance with various embodiments herein. In this embodiment, the vibration generator 238 can be used to both detect vibrations of the interior pane 112 as well as cause cancelling vibrations of the interior pane 112.

In some embodiments of the noise cancellation system, components thereof (some or all) can be disposed between the exterior pane 110 and the interior pane 112. For example, in some embodiments, components of the noise cancellation system can be disposed between the spacer unit 206 and the edges of the exterior pane 110 and the interior pane 112. However, in some embodiments, components of the noise cancellation system can be disposed above the spacer unit 206.

Figure 9:
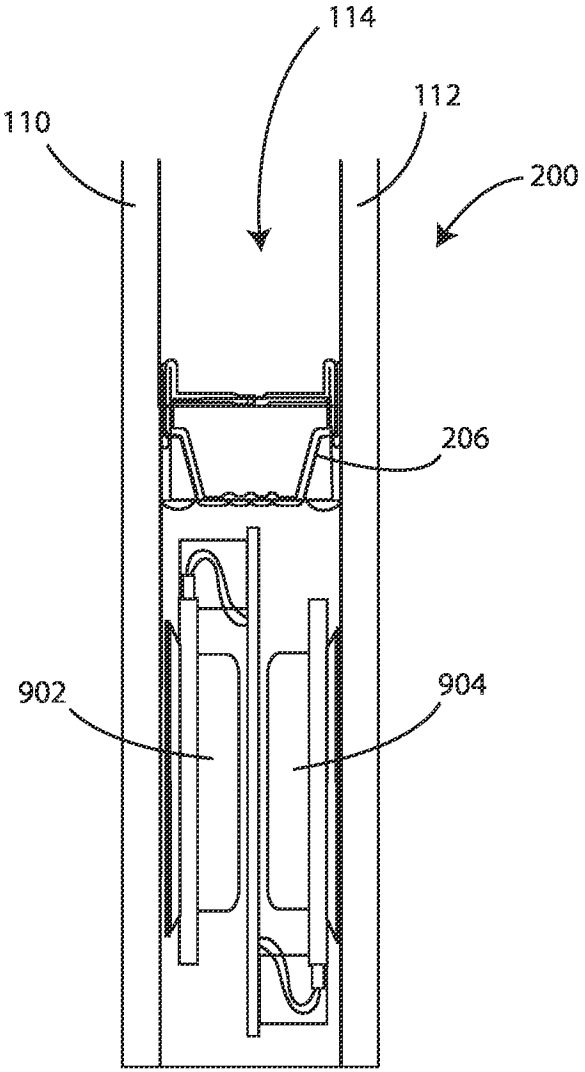
FIG. 9 is a schematic side view of a noise cancellation system in accordance with various embodiments herein.

Referring now to FIG. 9, a schematic side view is shown of a noise cancellation system 200 in accordance with various embodiments herein. A vibration or noise detection component 902 can be disposed between the exterior pane 110 and the interior pane 112. The vibration or noise detection component 902 can be attached to the exterior pane 110 and/or configured to detect vibrations of the exterior pane 110. A vibration generator 904 can be configured to vibrate the interior pane 112.

Figure 10:
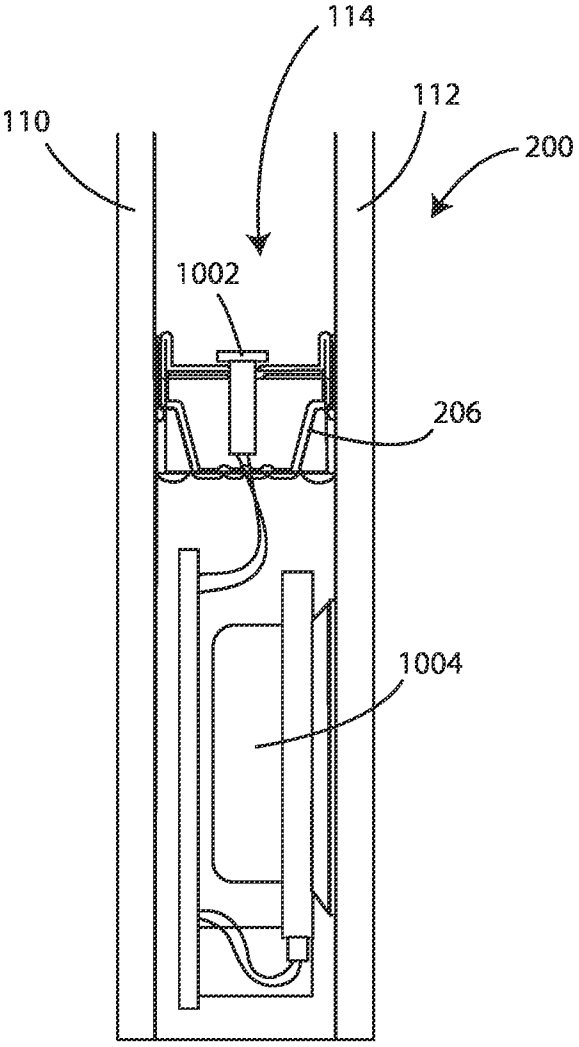
FIG. 10 is a schematic side view of a noise cancellation system in accordance with various embodiments herein.

In some embodiments, instead of, or in addition to, sensing vibration of the exterior pane 110 or the interior pane 112, pressure and/or sound can be sensed within the internal space 114 between the exterior pane 110 and the interior pane 112. Referring now to FIG. 10, a schematic side view is shown of a noise cancellation system in accordance with various embodiments herein. A microphone 1002 or vibration sensor can be positioned to detect pressure and/or sound within the internal space 114. The microphone 1002 can be attached to the spacer unit 206 in some embodiments, but in other embodiments can be detached therefrom.

Figure 12:
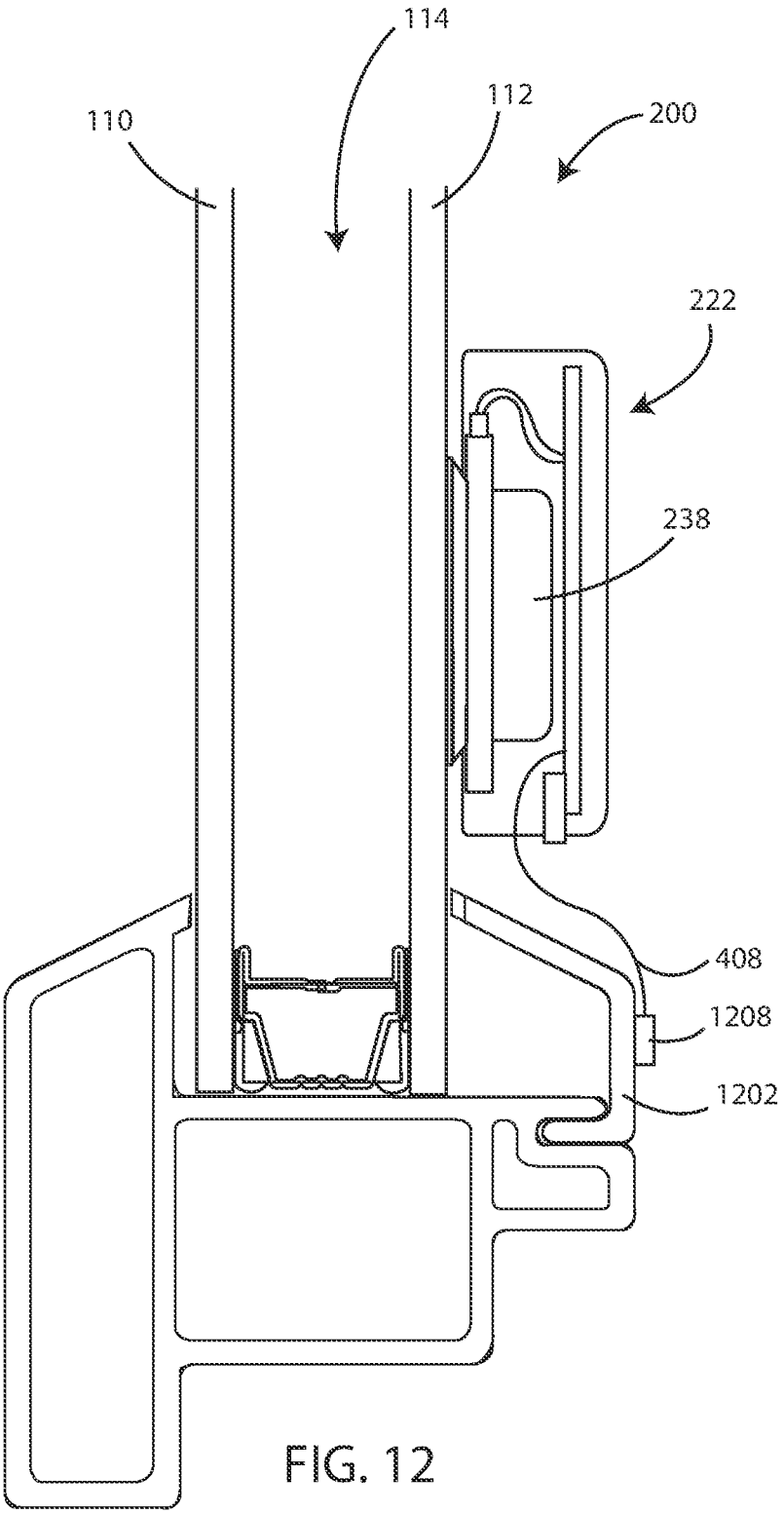
FIG. 12 is a schematic side view of a noise cancellation system in accordance with various embodiments herein.

Referring now to FIG. 12, a schematic side view is shown of a noise cancellation system 200 in accordance with various embodiments herein. In this embodiment, a sound or vibration sensor 1208 (or other transducer) is attached to a surface of a frame 1202. In some embodiments, the sound or vibration sensor 1208 can be embedded within the frame 1202. The frame 1202 can form part of a fenestration unit such as a window or door assembly. The signal from the sound or vibration sensor 1208 can be conveyed to the interior module 222 via a signal line 408 which can form part of a signal circuit. However, in some embodiments the signal can be conveyed to the interior module 222 wirelessly.

Figure 13:
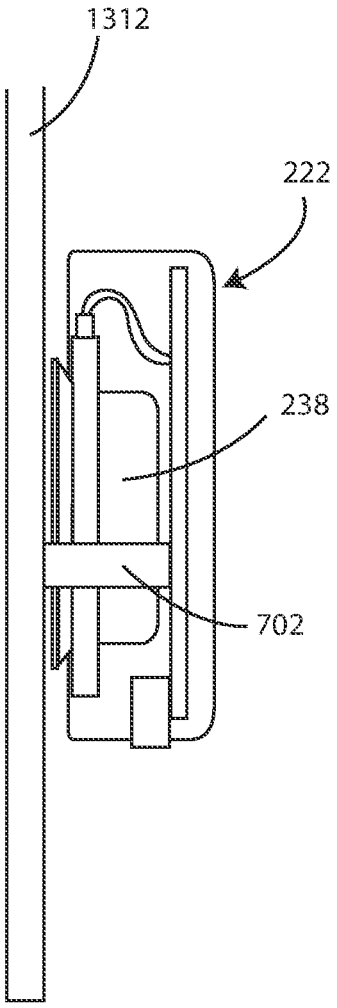
FIG. 13 is a schematic side view of a noise cancellation system in accordance with various embodiments herein.

It will be appreciated that embodiments herein can work with structures or systems including only a single pane of material. Referring now to FIG. 13, a schematic side view is shown of a noise cancellation system 200 in accordance with various embodiments herein. The interior module 222 of the noise cancellation system 200 can include a sound or vibration sensor 702 and a vibration generator 238 (such as a surface exciter or similar device). The sound or vibration sensor 702 can detect vibrations of a single pane 1312 of material. In some embodiments, the single pane 1312 is a single pane of transparent glass. The single pane 1312 can, in some embodiments, be a laminate made up of two or more sheets of glass adhered to one another using an adhesive, a polymer, or various other compounds.

Effects of Noise Cancellation

As described above, systems herein can be effective to reduce or substantially eliminate undesirable sounds originating from the outside of a structure as perceived on the inside of the structure. The degree of efficacy can vary based on many factors including the distance of the source of the noise from the fenestration unit, the original volume of the noise, the frequency of the noise, and the like. However, in various embodiments, systems herein can reduce the volume of noise originating from the outside by at least about 3, 4, 5, 6, 7, 8, 9, 10, 11, 12, 13, 14, 15, 16, 17, 18, 19, 20, 22.5, or 25 decibels as measured on the inside at a point within 5 cm of the interior surface of the interior pane of the unit. In some embodiments, the noise reduction can be within a range wherein any of the foregoing numbers can serve as the upper or lower bound of the range, provided that the upper bound is greater than the lower bound.

Sound Input Devices/Vibration Sensors

Sound input (sound pickup) devices can be included with embodiments herein. Sound input devices can include those having various types of directional response characteristics. Sound input devices can include those having various types of frequency response characteristics.

While in many cases herein reference is made to a microphone in the singular, it will be appreciated that in many embodiments multiple microphones can be used. In some cases the microphones can be used in a redundant manner. However, in some cases the microphones can be different in terms of their position, frequency response, or other characteristics.

In some embodiments, the sound input device can be a transducer that converts acoustical waves into electrical signals. The electrical signals can be either analog or digital.

In some embodiments, the sound input device can specifically be a microphone. Various types of microphones can be used. In some embodiments, the microphone can be an externally polarized condenser microphone, a prepolarized electret condenser microphone, or a piezoelectric microphone.

Sounds can cause vibration of materials. In various embodiments herein vibration sensors are included. Various types of devices can be used to detect vibrations. Vibration sensors can include, but are not limited to, piezoelectric devices (including but not limited to piezoelectric films), accelerometers (digital or analog), velocity sensors, and the like. Vibration sensors can operate by detecting one or more of displacement, velocity, and acceleration, amongst other approaches.

In various embodiments herein, accelerometers can be used to detect sound and/or vibration of an element of the system. Accelerometers can be of various types including, but not limited to, capacitive accelerometers, piezoelectric accelerometers, potentiometric accelerometers, reluctive accelerometers, servo accelerometers, strain gauge accelerators, and the like.

In some embodiments herein, velocity sensors can be used to detect sound and/or vibration of an element of the system. Velocity sensors can include, but are not limited to, electromagnetic linear velocity transducers and electromagnetic tachometer generators.

In some embodiments herein, the sound input device or vibration sensor can be coupled with the vibration generator as one component. By way of example, some sound transducers can serve both to detect sound or vibration as well as generate sound or vibration. For example, a conventional acoustic speaker can be used to both detect sound or vibration as well as produce sound or vibration.

Vibration Generators

Various embodiments herein include vibration generators. Vibration generators herein can include direct or indirect vibration generators. A direct vibration generator is a device that can create vibrations through direct physical contact between the device generating vibrations and the element to be vibrated. An indirect vibration generator is a device that creates vibrations in an element to be vibrated, but not through direct physical contact. Rather an indirect vibration generator can generate vibrations through various indirect techniques such as emitting pressure waves through the air and/or generating varying electromagnetic fields that can interact directly with an element to be vibrated or a portion thereof such as a magnet.

Vibration generators can specifically include a conventional acoustic speaker or a portion thereof. For example, in some embodiments, the vibration generator can include a construction similar to a conventional acoustic speaker, but without the cone.

In some embodiments, a magnetostrictive material can be used to form a vibration generator. Magnetostrictive materials expand and contract in a magnetic field. An exemplary magnetostrictive material is terfenol-D, which is an alloy of terbium, iron and dysprosium. As such, a magnetostrictive material can be exposed to a varying magnetic field in order to generate vibrations forming a magnetostrictive transducer or actuator. For example, wire can be wrapped around a magnetostrictive material forming a coil. The magnetostrictive material, or something connected thereto, can in turn be bonded to a structure to be vibrated, such as a membrane or a pane of a unit described herein, causing that material to move as a current is passed through the wire.

In some embodiments, an acoustic exciter can serve as a vibration generator. Acoustic exciters can be of various types. In some embodiments, the acoustic exciter is similar to a conventional acoustic speaker. In some embodiments, the acoustic exciter is similar to a conventional acoustic speaker, however without certain components thereof such as without one or more of the cone, surround, frame, and/or spider. In some embodiments the acoustic exciter can include a permanent magnet including, but not limited to, a neodymium magnet. The acoustic exciter can also include a coil, commonly referred to as a voice coil. When electric current flows through the voice coil, the coil forms an electromagnet. The electromagnet can be positioned within a constant magnetic field created by the permanent magnet. As the current through the coil changes, the relative repulsion and/or attraction of the electromagnet with respect to the permanent magnet changes which can cause movement of the coil relative to the permanent magnet leading to vibrations and/or sound waves.

In some embodiments, the coil can be connected to a diaphragm which can create pressure waves or sound. In some embodiments, the coil can be connected (directly or indirectly) to an element of the system to be vibrated, such as the interior pane. In some embodiments, the permanent magnet can be connected (directly or indirectly) to an element of the system to be vibrated, such as the interior pane.

Exemplary acoustic exciters (or surface exciters) can include those commercially available from Dayton Audio, Springboro, Ohio; PUI Audio Inc., Dayton, Ohio; and Soberton, Inc., Minneapolis, Minn.

In some embodiments, a piezoelectric vibration generator can serve as the vibration generator. For example, a piezoelectric vibration generator includes a piezoelectric material which can connected to an element of the system to be vibrated (directly or indirectly). When an electric charge is applied to a piezoelectric material, it can generate a mechanical stress which, when the electric charge is varied, can result in a vibration.

Non-Fenestration Applications

While many embodiments herein are directed to fenestration units such as doors, windows, and similar structures, it will be appreciated that the components and principals herein can also be usefully applied to non-fenestration applications. For example, instead of transparent exterior and interior panes, the system can also function in the context of a structural member having exterior and interior sheets of construction materials such as plywood, oriented strand board, particle board, sheet rock, polymeric sheets, and other sheeting materials.

In an embodiment, a building material unit with active sound canceling properties can be included. The building material unit can have an exterior sheet of material, an interior sheet of material, and an internal space disposed between the exterior and interior sheets of material. The unit can also include an active noise cancellation system including an exterior module connected to the exterior sheet. The exterior module can include a sound input device, and a signal emitter configured to emit a signal based on a signal received from the sound input device. The active noise cancellation system can include an interior module connected to the interior sheet. The interior module can include a signal receiver to receive the signal from the signal emitter and a vibration generator configured to vibrate the interior sheet. The system can further include a sound cancellation control module in electrical communication with at least one of the exterior module and the interior module.

The sound cancellation control module can control the vibration generator to vibrate the interior sheet and generate pressure waves causing destructive interference with a portion of the sound waves received by the sound input device. The sound cancellation control module can perform various steps including, but not limited to, filtering one or more signals representing sound, segmenting the signal into discrete frequency portions (or channels), generating inverse phase signals, recombining discrete frequency portions into a unitary inverse phase signal, and acting as a vibration generator driver or controlling the same. The sound cancellation control module can be implemented using any suitable technology, and may include, for example, a printed circuit board (PCB) with one or more microchips, such as a microcontroller, a programmable logic controller (PLC), an ASIC, an FPGA, a microprocessor, a digital signal processing (DSP) chip, or other suitable technology.

Sounds Cancellation Circuits/Methods

Figure 11:
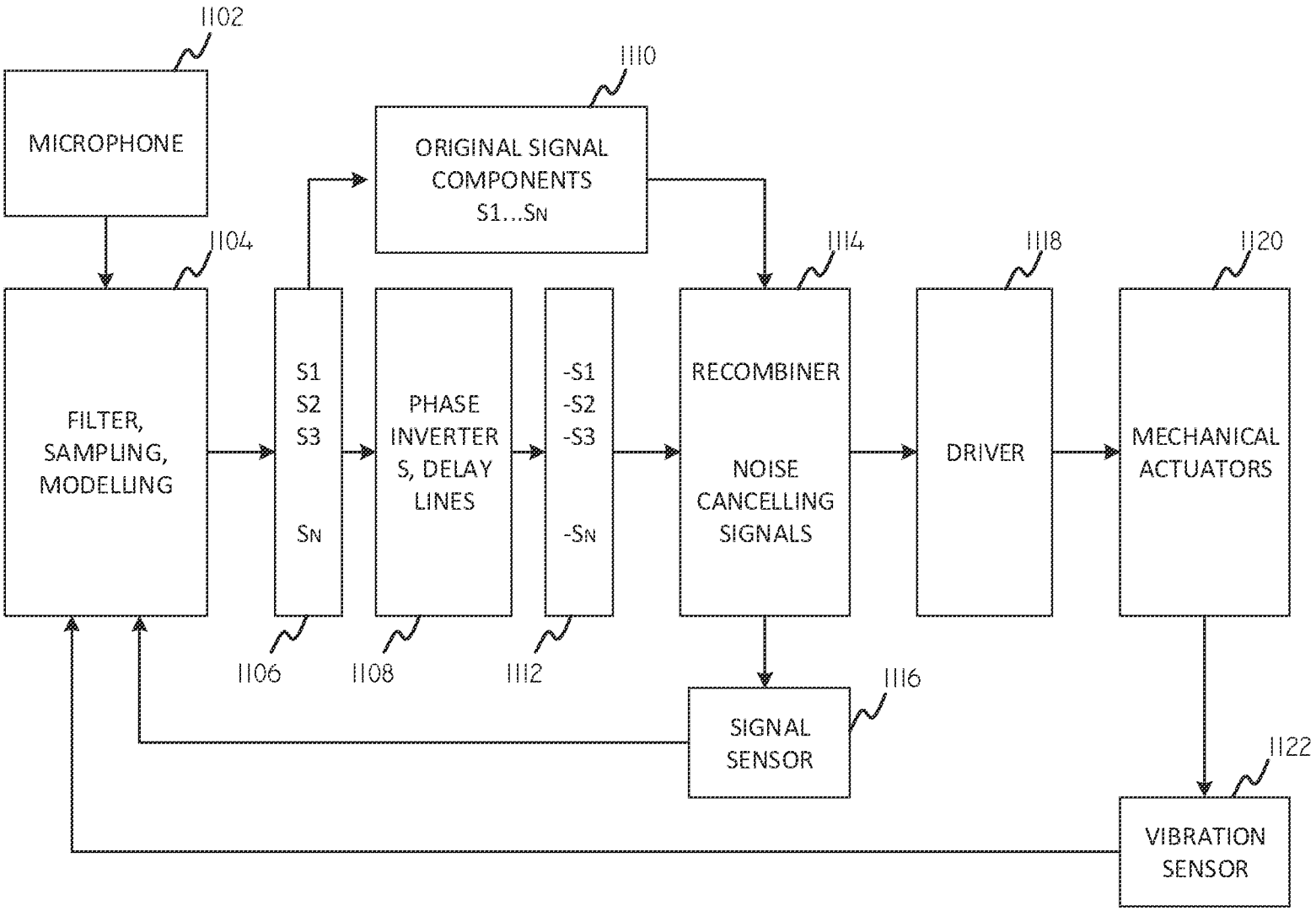
FIG. 11 is a block view of components of a sound cancellation system.

Sound cancellation can be achieved in various ways. In many embodiments, sound or vibration is sensed and then opposite sound or vibration (or inverse-phase) is generated in order to cancel or at least partially cancel the original sound or vibration. Referring now to FIG. 11, a block diagram is shown of one embodiment of how components of such a system can work together in order to cancel, or at least partially cancel, sound or vibration. One or more of the components discussed with regard to FIG. 11 can form a sound cancellation control module. One or more of these components can be housed within an interior module, an exterior module or even separately, outside of an interior module or exterior module.

A sound or vibration pick-up device, such as a microphone 1102 can be used to detect sound or vibration. The signal from the microphone 1102 can be processed by a processing module 1104. The processing module 1104 can execute steps including, but not limited to, filtering, sampling, and modelling. In some embodiments, filtering can achieve breaking the incoming sound into segments 1106, such as segments having particular ranges of frequencies.

Various filter elements can be used in order to break the signal into multiple discrete segments 1106 including, but not limited to, high pass filters, low pass filters, bandpass filters, and the like. The number of segments that the incoming sound can be broken into can vary. In some embodiments, there are from 1 to 100 segments. In some embodiments, there are from 2 to 40 segments.

The segments 1106 than then pass to a phase inverter and/or delay processing module 1108. This module can process the signals in order to create a phase inverted version 1112 of the original signals (or noise cancelling signals). A portion of the original signals 1110 can simultaneously pass by this step for later processing.

A recombination module 1114 can then take the phase inverted segmented signals 1112 and recombine them into a cancelling signal that can then be fed into a driver 1118 which operates one or more mechanical actuators 1120 in order to create cancelling sounds or vibrations.

Various feedback loops can be used in accordance with embodiments herein. In some embodiments, the original signals 1110 and/or noise cancelling signals can pass to a signal sensor 1116, the output of which can be fed back into the processing module 1104. In addition, a vibration sensor 1122 can be configured to pick up the output of the mechanical actuators 1120 and the resulting signal can also be fed back into the processing module 1104.

In various embodiments herein, the system can include self-calibration features. By way of example, feedback loops, such as those referenced above can be used to tune the relative effectiveness of the inverted phase signals in cancelling out the original signals. Self-calibration can be configured to happen substantially continuously or at intervals of time. Self-calibration can be effective to account for differences between different scenarios of use including different size panes, different pane materials, laminated versus non-laminated glass, different framing structures, different gas types in the interior space between panes, different resonant frequencies, and the like.

For example, in a self-calibration operation mode, the sound cancellation control module can make changes to how the inverted phase cancellation vibration or sound is generated (such as makes changes to one or more of amplitude, frequency, frequency bandwidth, etc.) and evaluate the resulting attenuation to determine if the changes are beneficial or not. For example, the sound cancellation control module can be configured to change at least one of the amplitude and bandwidth of vibration generated by the vibration generator at one or more of the discrete frequency bands. In some cases, the sound cancellation control module can start by changing amplitude by an absolute or relative amount, which could be an increase or decrease. In some cases, the sound cancellation control module can start by changing bandwidth of vibration by an absolute or relative amount, which could be moving to higher frequencies, lower frequencies, a broader frequency range or a narrower frequency range. In some cases, both amplitude and bandwidth of vibration generated can be changed simultaneously.

The sound cancellation control module can be configured to retain the change in at least one of the amplitude and bandwidth of vibration generated by the vibration generator at one or more of the discrete frequency bands if the average attenuation of incident noise is increased and reject the change in at least one of the amplitude and bandwidth of vibration generated by the vibration generator at one or more of the discrete frequency bands if the average attenuation of incident noise is decreased. This process can be repeated multiple times in order to maximize the average attenuation of incident noise. This process can be repeated multiple times in order to maximize the average attenuation of incident noise. In some cases, this process can be repeated at least 3, 5, 7, 9, 15, 20, 30, 40, 50, or 100 times or more before the parameters resulting in the best attenuation of incident noise are determined to be optimal. In some embodiments, the process can proceed according to an optimization algorithm. An optimization algorithm is a procedure that is executed iteratively by comparing various solutions till an optimum or a satisfactory solution is found. Optimization algorithms here can include both deterministic and stochastic algorithms.

Elements of the system including, but not limited to, the filters and other processing components described herein can be analog circuit components or can be modules of a digital signal processing system. Elements herein can be implemented using any suitable technology, and may include, for example, a printed circuit board (PCB) with one or more microchips, such as a microcontroller, a programmable logic controller (PLC), an ASIC, an FPGA, a microprocessor, a digital signal processing (DSP) chip, or other suitable technology.

In some embodiments, the system can include a wireless communications module in order to connect with other devices and/or a network for transmission and receiving of data and/or commands, amongst other purposes. In some embodiments, the system can include a WIFI, Bluetooth, cellular, or other communications chip in order to allow the system to communicate either other devices.

Multiband Attenuation

Well not intending to be bound by theory, it is believed that creating cancelling sound or pressure waves targeting specific bandwidths can lead to more efficient and in some cases greater average sound attenuation than creating cancelling sound or pressure waves across a broad frequency range.

Figure 14:
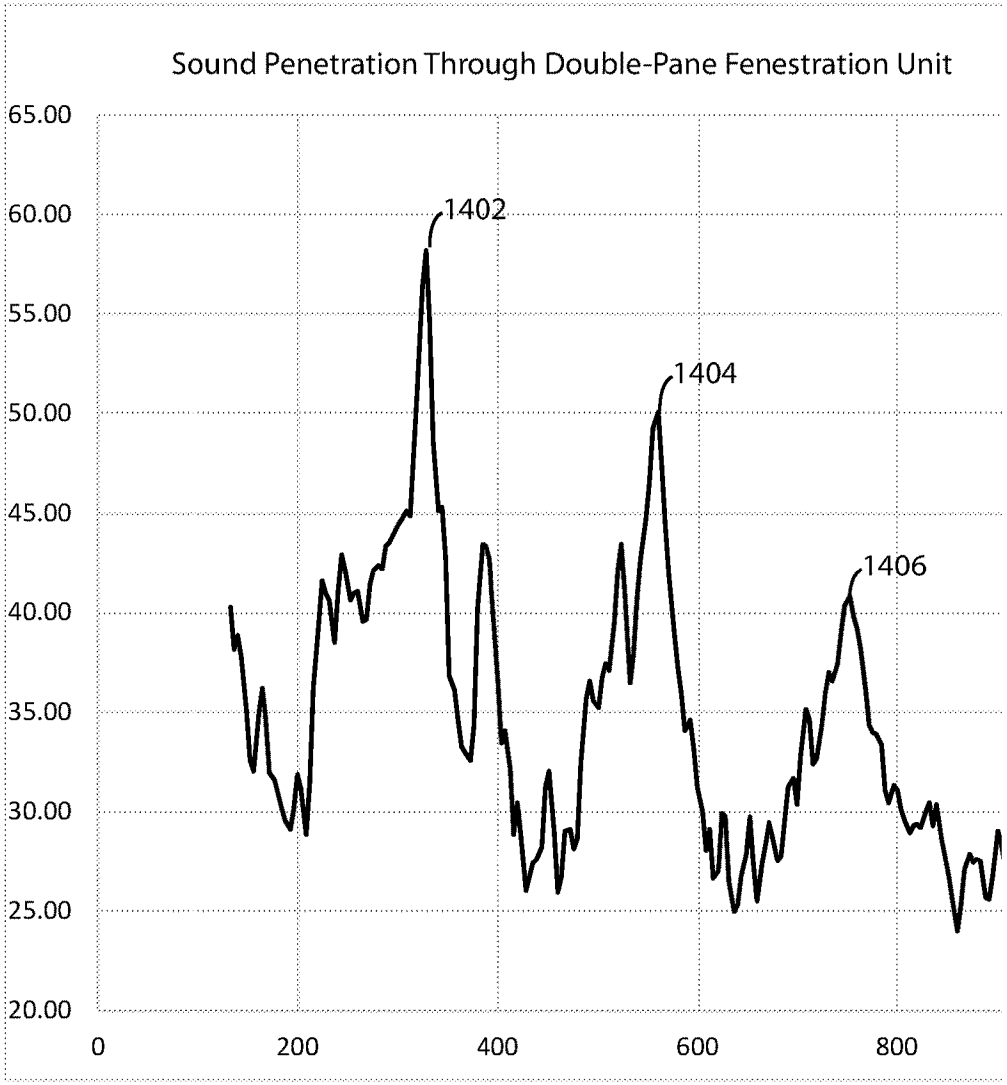
FIG. 14 is a sound frequency spectrum illustrating frequencies that penetrate an exemplary double-pane fenestration unit.

Referring now to FIG. 14, a sound frequency spectrum is shown illustrating frequencies that penetrate an exemplary double-pane fenestration unit. This spectrum was generated using both white and pink noise generated on the outside of an exemplary double-pane fenestration unit and then recording sound on the inside of the exemplary double-pane fenestration unit. This spectrum shows a first major peak 1402 at approximately 328 Hz, a second major peak 1404 at approximately 560 Hz, and a third major peak 1406 at approximately 752 Hz. Remarkably, it has been found that the frequencies at which these peaks occur do not change substantially despite difference in pane thickness, pane size, number of panes, frame materials, ambient temperatures, and the like.

Figure 15:
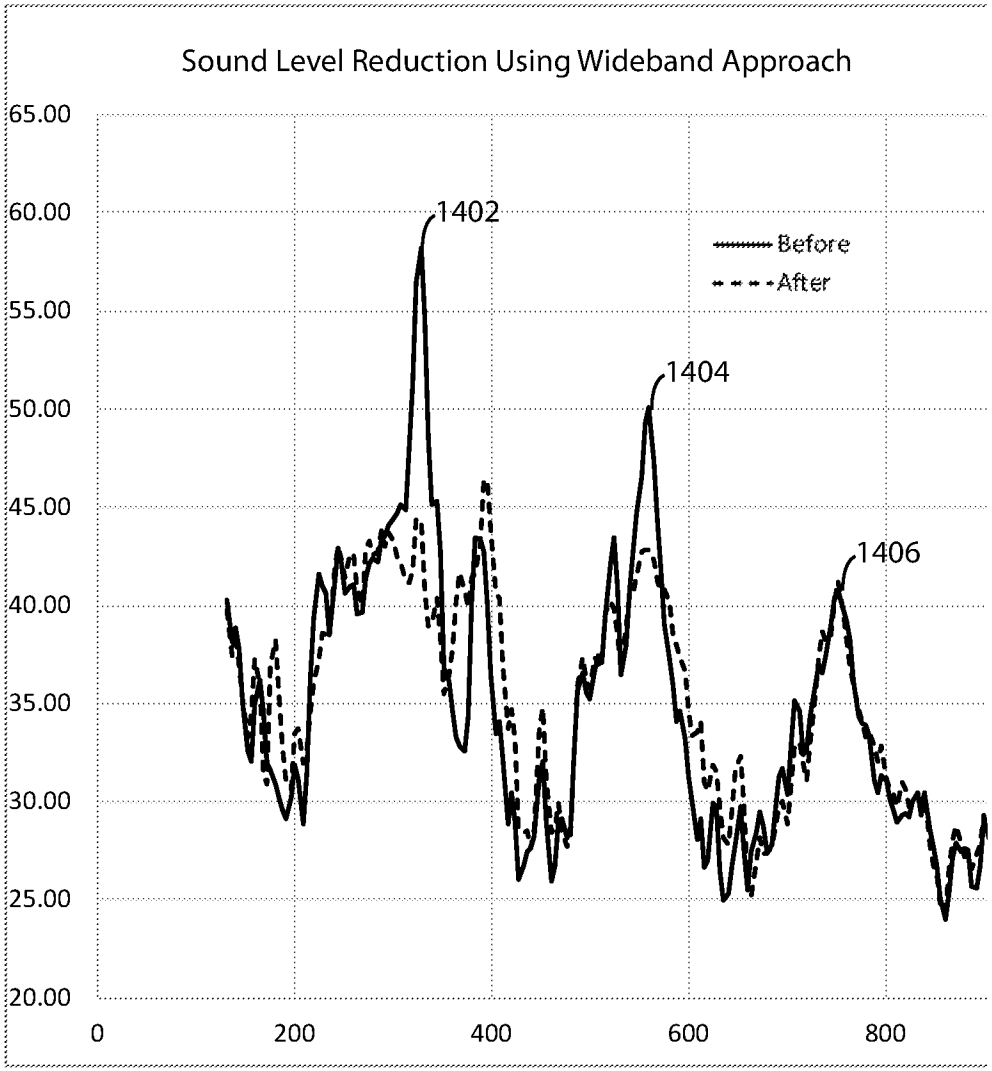
FIG. 15 is a sound frequency spectrum illustrating the attenuation of sound that penetrate an exemplary double-pane fenestration unit using a wideband cancellation approach.

Referring now to FIG. 15, a sound frequency spectrum is shown illustrating the effectiveness of a wideband cancellation approach on frequencies that penetrate an exemplary double-pane fenestration unit. For this example, a wideband cancellation signal was generated (e.g., generating a cancellation sound or vibration) across the range of 150 Hz to 800 Hz. As can be seen, the first major peak 1402 and the second major peak 1404 decreased substantially. In this case, however, the third major peak 1406 did not experience a similar degree of attenuation.

In accordance with various embodiments herein, a sound cancellation control module can evaluate detected vibration (such as vibration of a transparent pane) at two or more discrete frequency bands. For example, in some embodiments, the sound cancelation control module can evaluate detected vibration at from two to six discrete frequency bands. Also, in some embodiments, a sound cancellation control module can cause the vibration generator to generate vibration (or pressure waves) causing destructive interference with sound waves at two or more discrete frequency bands. For example, in some embodiments, the sound cancellation control module can cause the vibration generator to generate vibration (or pressure waves) causing destructive interference with sound waves at from two to six discrete frequency bands.

Figure 16:
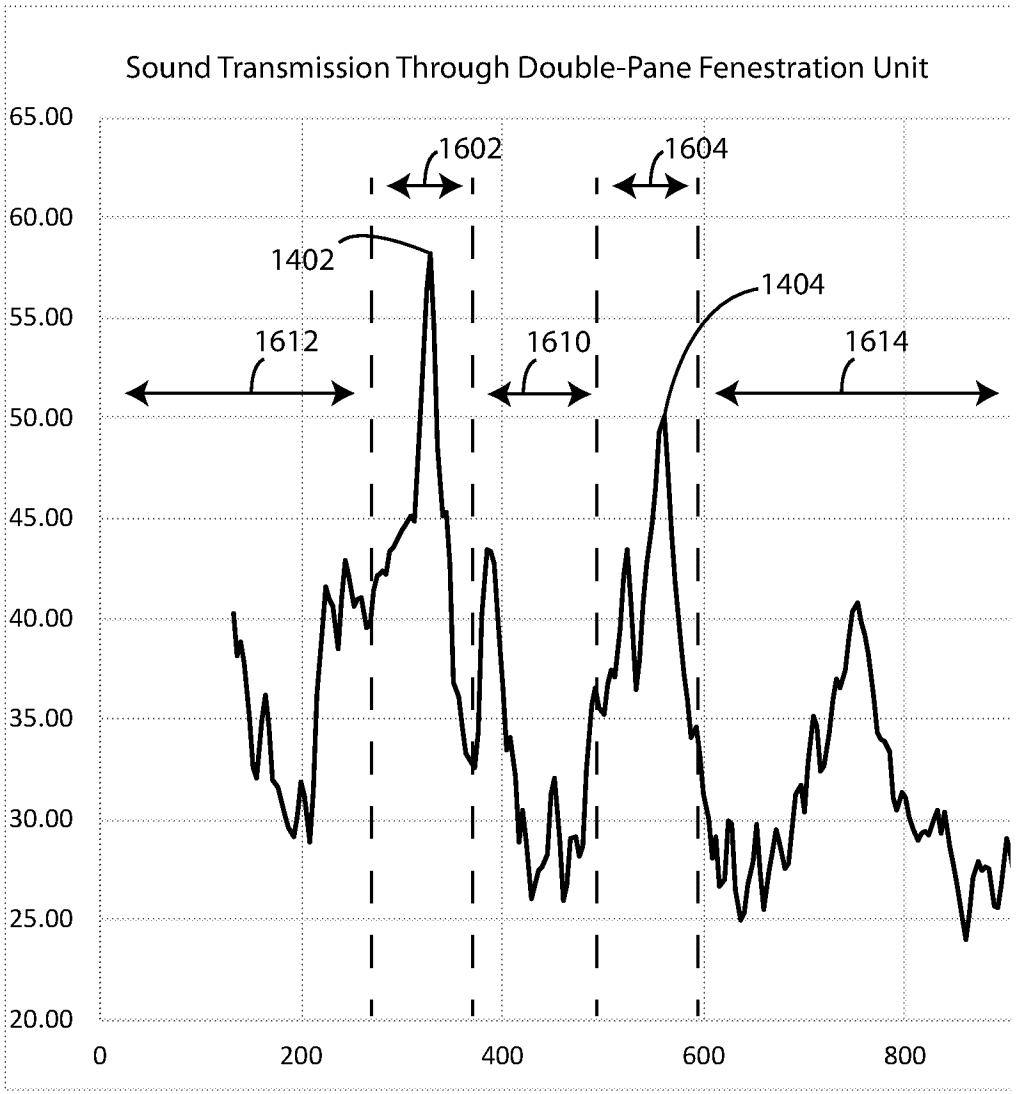
FIG. 16 is a sound frequency spectrum illustrating frequency bands that are targeted for sound cancellation in accordance with various embodiments herein.

Referring now to FIG. 16, a sound frequency spectrum is shown illustrating frequency bands that are targeted for sound cancellation in accordance with various embodiments herein. In this example, there is a first discrete frequency band 1602 that surrounds the first major peak 1402. There is also a second discrete frequency band 1604 that surrounds the second major peak 1404. The first discrete frequency band 1602 and the second discrete frequency band 1604 can be separated by a bandwidth gap 1610. In addition, a low frequency bandwidth gap 1612 exists between the first discrete frequency band 1602 and 0 Hz. Further, a high frequency bandwidth gap 1614 exists above the second discrete frequency band 1604.

In some embodiments, incident sound (e.g., sound incident on panes or sheets of material herein) within bandwidth gaps 1610, 1612, and 1614 is not used by the system when performing calculations to generate phase inverted attenuating sound, vibration or pressure waves. In some embodiments, incident sound within bandwidth gaps 1602 and 1604 is used by the system, but only for purposes of measuring the magnitude of incident sound across a wide band of frequencies and/or only for purposes of measuring the magnitude of sound attenuation across a wide band of frequencies.

In some embodiments, the vibration generator generates vibration such that at least 60, 70, 80, 85, 90, 95, 98, 99, or 100% of vibration generated is at frequencies falling within at least two or more discrete frequency bands.

In some embodiments, two or more discrete frequency bands have the same bandwidth size, wherein bandwidth is the difference between the upper and lower frequencies in a continuous band of frequencies. In some embodiments, two or more discrete frequency bands have different bandwidth sizes.

The bandwidth of each of the discrete frequency bands can vary in size. In some embodiments, the bandwidth of the discrete frequency bands can be about 10, 20, 30, 40, 50, 60, 70, 80, 90, 100, 120, 140, 160, 180, 200, 220, 240, 260, 280, or 300 Hz in width or can have a width falling within a range between any of the foregoing.

The gap between targeted discrete frequency bands (e.g., the bandwidth of gaps such as 1610) can vary. In some embodiments, two or more discrete frequency bands are separated from one another by at least 10, 20, 30, 40, 50, 60, 70, 80, 90, 100, 120, 150 or 200 Hz.

In some embodiments, the lowest frequency band of the two or more discrete frequency bands can cover (or at least a portion thereof) the frequencies from 260 Hz to 400 Hz, from 280 Hz to 380 Hz, from 300 Hz to 360 Hz, 320 Hz to 340 Hz, 324 Hz to 332 Hz, or 326 Hz to 330 Hz.

In some embodiments, the second lowest frequency band of the two or more discrete frequency bands can cover (or at least a portion thereof) the frequencies from 490 Hz to 630 Hz, 510 Hz to 610 Hz, 530 Hz to 590 Hz, 550 Hz to 570 Hz, 556 Hz to 564 Hz, or 558 Hz to 562 Hz.

The sound cancellation control module can independently control at least one of frequency bandwidth and cancellation amplitude at the two or more discrete frequency bands. In some embodiments, the amplitude of generated vibration or pressure waves for cancellation at the lowest frequency band is greater than the amplitude of generated pressure waves for cancellation at the next frequency band (e.g., the next frequency band up from the lowest).

In some embodiments, the sound cancellation control module can use a feedback loop to control the vibration generator. In some embodiments, the sound cancellation control module can make changes to how the inverted phase cancellation vibration or sound is generated (such as makes changes to one or more of amplitude, frequency, frequency bandwidth, etc.) and evaluate the resulting attenuation to determine if the changes are beneficial or not. For example, the sound cancellation control module can be configured to change at least one of the amplitude and bandwidth of vibration generated by the vibration generator at one or more of the discrete frequency bands. In some cases, the sound cancellation control module can start by changing amplitude by an absolute or relative amount, which could be an increase or decrease. In some cases, the sound cancellation control module can start by changing bandwidth of vibration by an absolute or relative amount, which could be moving to higher frequencies, lower frequencies, a broader frequency range or a narrower frequency range. In some cases, both amplitude and bandwidth of vibration generated can be changed simultaneously.

The sound cancellation control module can also be configured to evaluate average attenuation of incident noise across a frequency band of 100 to 900 Hz or from 150 to 800 Hz, or another specific range. The sound cancellation control module can be configured to retain the change in at least one of the amplitude and bandwidth of vibration generated by the vibration generator at one or more of the discrete frequency bands if the average attenuation of incident noise is increased and reject the change in at least one of the amplitude and bandwidth of vibration generated by the vibration generator at one or more of the discrete frequency bands if the average attenuation of incident noise is decreased. This process can be repeated multiple times in order to maximize the average attenuation of incident noise. In some cases, this process can be repeated at least 3, 5, 7, 9, 15, 20, 30, 40, 50, or 100 times or more before the parameters resulting in the best attenuation of incident noise are determined to be optimal. In some embodiments, the process can proceed according to an optimization algorithm. Optimization algorithms here can include both deterministic and stochastic algorithms.

In some embodiments, changes with regard to vibration generated by the vibration generator (or phase inverted attenuating sound) can be made within multiple frequency bands simultaneously. In other embodiments, changes can be made only to a single frequency band followed by evaluation before other changes are made. In some embodiments, changes can be made within the lowest frequency band first, followed by evaluation and then changes made to higher frequency bands.

Figure 17:
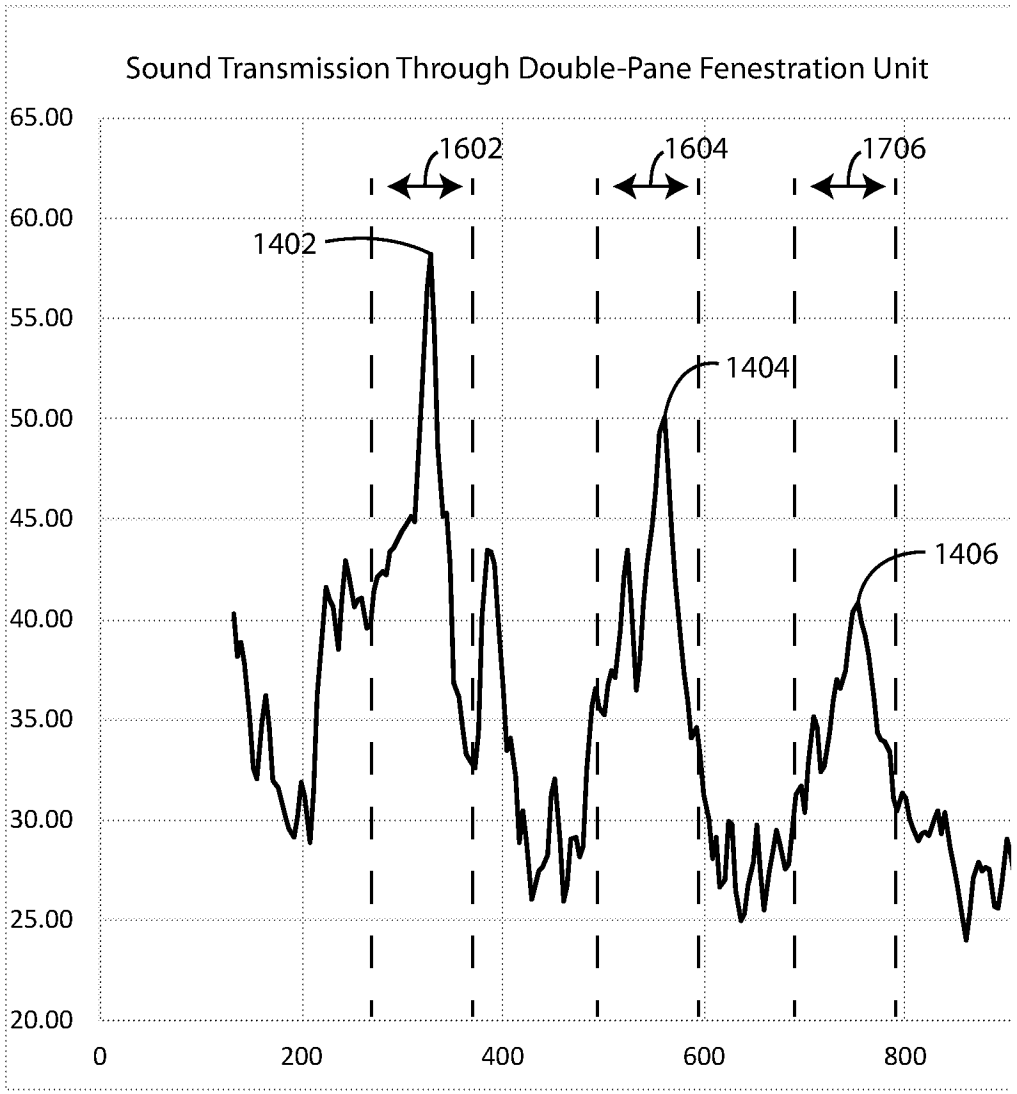
FIG. 17 is a sound frequency spectrum illustrating frequency bands that are targeted for sound cancellation in accordance with various embodiments herein.

It will be appreciated that frequency bands targeted for cancellation herein are not merely limited to two frequency bands. Three or more frequency bands can be targeted. In some embodiments, from one to six or from two to six frequency bands can be targeted. Referring now to FIG. 17, a sound frequency spectrum is shown illustrating frequency bands that are targeted for sound cancellation in accordance with various embodiments herein. In this example, there is a first discrete frequency band 1602 that surrounds the first major peak 1402 and a second discrete frequency band 1604 that surrounds the second major peak 1404. There is also a third discrete frequency band 1706 that surrounds the third major peak 1406.

Methods

Various methods are also included herein and can include any steps or operations described in any section herein as well as those described below. In an embodiment, a method for attenuating sound incident on a pane of material is included herein. The method can include detecting vibration of the pane of material with a sensing element comprising at least one of a vibration sensor and a sound input device. The method can also include generating vibration at two or more discrete frequency bands to cause destructive interference with incident sound waves causing vibration of the pane of material.

In some embodiments, the method can include evaluating the detected vibration of the transparent pane at from two to six discrete frequency bands. In some embodiments, the method can include generating vibration causing destructive interference with sound waves at from two to six discrete frequency bands.

In some embodiments, the method can include generating vibration such that at least 80% of vibration generated are at frequencies falling within the at least two or more discrete frequency bands. In some embodiments, the method can include generating vibration such that at least 95% of vibration generated is at frequencies falling within the at least two or more discrete frequency bands.

In some embodiments of the method, the two or more discrete frequency bands have the same bandwidth size. In some embodiments of the method, the two or more discrete frequency bands have different bandwidth sizes. In some embodiments of the method, the two or more discrete frequency bands are separated from one another by at least 50 Hz. In some embodiments of the method, the two or more discrete frequency bands are separated from one another by at least 100 Hz.

In some embodiments of the method, the bandwidth of each of the two or more discrete frequency bands is from 10 Hz to 200 Hz in width. In some embodiments of the method, the lowest frequency band of the two or more discrete frequency bands covers at least a portion of the frequencies from 280 Hz to 380 Hz. In some embodiments of the method, the second lowest frequency band of the two or more discrete frequency bands covers at least a portion of the frequencies from 510 Hz to 610 Hz.

In some embodiments, the method can include independently controlling at least one of frequency bandwidth and cancellation amplitude at the two or more discrete frequency bands. In some embodiments of the method, the amplitude of generated vibration for cancellation at the lowest frequency band is greater than the amplitude of generated vibration for cancellation at the next lowest frequency band.

In some embodiments of the method, the incident noise is attenuated by at least 8 decibels on average across a frequency band of 100 to 900 Hz. In some embodiments of the method, incident noise is attenuated by at least 10 decibels on average across a frequency band of 100 to 900 Hz. In some embodiments of the method, incident noise is attenuated by at least 12 decibels on average across a frequency band of 100 to 900 Hz.

In some embodiments, the method further includes using a feedback loop to control the vibration generator. In some embodiments, the method further includes changing at least one of the amplitude and bandwidth of vibration generated by the vibration generator at one or more of the discrete frequency bands. In some embodiments, the method further includes evaluating average attenuation of incident noise across a frequency band of 100 to 900 Hz. In some embodiments, the method further includes retaining the change in at least one of the amplitude and bandwidth of vibration generated by the vibration generator at one or more of the discrete frequency bands if the average attenuation of incident noise is increased. In some embodiments, the method further includes rejecting the change in at least one of the amplitude and bandwidth of vibration generated by the vibration generator at one or more of the discrete frequency bands if the average attenuation of incident noise is increased.

Selected Transmission of Desired Frequencies

In various embodiments herein, incoming sounds are broken up into frequency range segments before further processing. This segmentation approach offers unique benefits in that it can be possible to cancel certain sounds and magnify others. For example, children tend to speak and make noise at higher frequencies. Large commercial trucks are typically at lower frequencies than children. In some scenarios, it may be desirable to block out lower frequency truck noise while allowing higher frequency sounds from children to pass through or even be amplified.

As such, in some embodiments herein, different frequency segments are processed differently in order to accomplish this effect. In specific, in some embodiments, higher frequencies can be allowed to pass through (by not generating an inverted phase sound to block them) or even amplified by the system while lower frequency sounds can be cancelled. For example, it may be desirable to allow frequencies associate with children or with alarms to pass through while blocking frequencies associated with trucks, trains, or lawn mowers.

Pressure waves (sound waves) generally must have a frequency of between about 20 Hz and 20,000 Hz in order for humans to hear and perceive them as sound. In some embodiments, one or more ranges of frequencies can be selectively blocked while other frequencies are allowed to pass through, or selectively allowed through while others are blocked.

It will be appreciated that selective blocking or passage can be accomplished in accordance with embodiments herein across the frequencies of sound perceptible by the human ear.

In some embodiments herein, the system can receive a command and enter a recording mode to receive a sample of sound for either selective blocking or selective transmission. By way of example, a button can be mounted on a component of the system and actuations of the button can cause the system to enter a temporary mode where vibrations/sound received are then designated for selective blocking and/or selective transmission. In this manner, the system can be tuned by an end user in order to be able to selectively block or allow the transmission of sounds in any desired frequency range.

The embodiments described herein are not intended to be exhaustive or to limit the invention to the precise forms disclosed in the following detailed description. Rather, the embodiments are chosen and described so that others skilled in the art can appreciate and understand the principles and practices.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

The invention claimed is:

1. An active noise attenuation system comprising:

a sound control device configured to be connected to a pane, the sound control device comprising a sensing element comprising at least one of a vibration sensor configured to detect vibration of the pane; and a sound input device configured to detect sound incident on the pane;

a vibration generator configured to vibrate the pane; and a control module in communication with the sensing element and the vibration generator;

wherein the control module evaluates the detected vibration of the pane within at least two targeted frequency bands;

wherein the control module causes the vibration generator to vibrate the pane causing destructive interference with sound waves within the at least two targeted frequency bands.

2. The active noise attenuation system of claim 1, wherein the at least two targeted frequency bands are discrete from one another.

3. The active noise attenuation system of claim 1, wherein the pane is a transparent pane.

4. The active noise attenuation system of claim 1, wherein the control module uses a feedback loop to control the vibration generator.

5. The active noise attenuation system of claim 1, wherein the control module is configured to make changes to one or more of amplitude, frequency, frequency bandwidth, of inverted phase vibration or sound and reevaluate the detected vibration of the pane within the at least two targeted frequency bands.

6. The active noise attenuation system of claim 5, wherein the control module makes the changes while operating in a self-calibration operation mode.

7. The active noise attenuation system of claim 5, wherein the control module is configured to retain the changes if the average attenuation of incident noise is increased and reject the changes if the average attenuation of incident noise is decreased.

8. The active noise attenuation system of claim 1, the pane comprising a sheet of material.

9. The active noise attenuation system of claim 1, the pane comprising a non-laminated glass.

10. The active noise attenuation system of claim 1, the pane comprising a laminated glass.

11. The active noise attenuation system of claim 1, wherein at least 80% of vibration generated is at frequencies falling within the at least two targeted frequency bands.

12. A fenestration unit with active noise attenuation comprising:

a pane of material;

a sound control device configured to be connected to the pane, the sound control device comprising a sensing element comprising at least one of a vibration sensor configured to detect vibration of the transparent pane; and a sound input device configured to detect sound incident on the transparent pane;

a vibration generator configured to vibrate the pane; and a control module in communication with the sensing element and the vibration generator;

wherein the control module evaluates the detected vibration of the pane within at least two targeted frequency bands;

wherein the control module causes the vibration generator to vibrate the pane causing destructive interference with sound waves within the at least two targeted frequency bands.

13. The active noise attenuation system of claim 12, wherein the at least two targeted frequency bands are discrete from one another.

14. The active noise attenuation system of claim 12, wherein the pane is a transparent pane.

15. The active noise attenuation system of claim 12, wherein the control module uses a feedback loop to control the vibration generator.

16. The active noise attenuation system of claim 12, wherein the control module is configured to make changes to one or more of amplitude, frequency, frequency bandwidth, of inverted phase vibration or sound and reevaluate the detected vibration of the pane within the at least two targeted frequency bands.

17. The active noise attenuation system of claim 16, wherein the control module makes the changes while operating in a self-calibration operation mode.

18. The active noise attenuation system of claim 16, wherein the control module is configured to retain the changes if the average attenuation of incident noise is increased and reject the changes if the average attenuation of incident noise is decreased.

19. The active noise attenuation system of claim 12, the pane comprising a sheet of material.

20. The active noise attenuation system of claim 12, the pane comprising a non-laminated glass.

21. The active noise attenuation system of claim 12, the pane comprising a laminated glass.

* * * * *